US009557040B2

(12) United States Patent
Zhang et al.

(10) Patent No.: US 9,557,040 B2
(45) Date of Patent: Jan. 31, 2017

(54) LIGHTING DEVICE

(71) Applicant: PHILIPS LIGHTING HOLDING B.V., Eindhoven (NL)

(72) Inventors: Ming Zhang, Eindhoven (NL); Bo Pan, Eindhoven (NL); Wen Gu, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/025,959

(22) PCT Filed: Sep. 30, 2014

(86) PCT No.: PCT/EP2014/070994

§ 371 (c)(1),
(2) Date: Mar. 30, 2016

(87) PCT Pub. No.: WO2015/044464

PCT Pub. Date: Apr. 2, 2015

(65) Prior Publication Data

US 2016/0238219 A1 Aug. 18, 2016

(30) Foreign Application Priority Data

Sep. 30, 2013 (CN) ..... PCT/CN2013/001185
Nov. 28, 2013 (EP) ..... 13194773

(51) Int. Cl.
*F21V 3/00* (2015.01)
*F21V 5/00* (2015.01)
(Continued)

(52) U.S. Cl.
CPC ..... *F21V 19/0085* (2013.01); *F21K 9/175* (2013.01); *F21S 8/026* (2013.01); *F21V 21/002* (2013.01);
(Continued)

(58) Field of Classification Search
CPC ..... F21V 19/0085; F21V 21/03; F21S 8/026; F21Y 2105/008; F21Y 2101/02; F21K 9/17; F21K 9/175
See application file for complete search history.

(56) References Cited

U.S. PATENT DOCUMENTS 6,733,159 B1 5/2004 Wu
2009/0091929 A1* 4/2009 Faubion ..... F21S 48/325 362/234
(Continued)

FOREIGN PATENT DOCUMENTS

DE 202011101343 U1 10/2011
DE 202012004156 U1 9/2012
(Continued)

OTHER PUBLICATIONS

New Cree UR Series LED Upgrade Kit Breaks Payback Barrier to Obsolete Linear Fluorescent Lighting, published Jun. 4, 2013, last seen at http://www.cree.com/News-and-Events/Cree-News/Press-Releases/2013/June/UR-upgrade-kit.

*Primary Examiner* — Peggy Neils
*Assistant Examiner* — Alexander Garlen

(57) ABSTRACT

The present application discloses a lighting device, which comprises a light source (110), a connection structure (120) comprising a cap (122, 124) provided at an end thereof, and a transmission mechanism (130); the cap is electrically connected with the light source; the transmission mechanism comprises a driving component (132) movably connected to a rotation component (134) on which the cap is mounted, wherein a movement of the driving component relative to the rotation component causes the rotation component with the cap to rotate. Just by touching, pressing, sliding or rotating a button (155) set on the surface of the panel (150), the rotation component is driven to rotate, and then the two
(Continued)

pins of the two caps are quickly inserted into the corresponding sockets.

14 Claims, 7 Drawing Sheets

(51) Int. Cl.

| | |
|---|---|
| ***F21V 19/00*** | (2006.01) |
| ***F21K 99/00*** | (2016.01) |
| ***F21S 8/02*** | (2006.01) |
| ***F21V 21/002*** | (2006.01) |
| ***F21V 21/03*** | (2006.01) |
| *F21Y 101/00* | (2016.01) |
| *F21Y 105/00* | (2016.01) |
| *F21Y 101/02* | (2006.01) |

(52) U.S. Cl.
CPC ..... *F21V 21/03* (2013.01); *F21Y 2101/00* (2013.01); *F21Y 2101/02* (2013.01); *F21Y 2105/00* (2013.01); *F21Y 2105/008* (2013.01); *F21Y 2115/15* (2016.08)

(56) References Cited

U.S. PATENT DOCUMENTS

| | | | | |
|---|---|---|---|---|
| 2009/0159919 | A1* | 6/2009 | Simon | F21K 9/175 257/99 |
| 2009/0280673 | A1 | 11/2009 | Kohen | |
| 2009/0280695 | A1* | 11/2009 | Sekela | F21V 21/002 439/699.2 |
| 2012/0106157 | A1* | 5/2012 | Simon | F21V 25/04 362/249.05 |
| 2013/0077296 | A1* | 3/2013 | Goeckel | F21V 7/00 362/217.07 |
| 2015/0022114 | A1* | 1/2015 | Kim | H05B 33/0803 315/294 |

FOREIGN PATENT DOCUMENTS

| | | | |
|---|---|---|---|
| FR | 2131297 | A4 | 11/1972 |
| JP | 2013118063 | A | 6/2013 |
| KR | 2011123989 | A | 11/2011 |

* cited by examiner

LIGHTING DEVICE

CROSS-REFERENCE TO PRIOR APPLICATIONS

This application is the U.S. National Phase application under 35 U.S.C. §371 of International Application No. PCT/EP2014/070994, filed on Sep. 30, 2014, which claims the benefit of European application number 13194773.1, filed Nov. 28, 2013, and International application number PCT/CN2013/001185, filed Sep. 30, 2013. These applications are hereby incorporated by reference herein.

FIELD OF THE INVENTION

The application is related to a lighting device, especially to a lighting device with skillful installation mechanism.

BACKGROUND OF THE INVENTION

As LED gets more and more popular, TLEDs are used widely to replace fluorescent lamps. Even if it usually takes only a fewer minutes to finish installation or maintenance, a much easier installation interface is still desirable. JP2013118063 discloses a LED lighting apparatus. It has a panel, two tubes, and the tubes are supported by plurality of hanging parts provided on the upper surface of the LED panel. It seems easy to get the tubes stuck in the hanging parts; however, the structure is not mechanically stable and doesn't work either for the luminaire without a panel.

SUMMARY OF THE INVENTION

It is one object of the present application to provide a lighting device to simplify installation or maintenance.

According to the present invention, it comprises a light source, a connection structure comprising a cap provided at an end thereof, and a transmission mechanism, wherein the cap is electrically connected with the light source and has a contact part for being inserted into an external socket, and the transmission mechanism comprises a driving component movably connected to a rotation component on which the cap is mounted, wherein a movement of the driving component relative to the rotation component causes the rotation component with the cap to rotate.

According to one embodiment of the present invention, a panel is mechanically connected with the connection structure and movably connected with the driving component via a button provided on the panel at a place corresponding to the cap of the connection structure.

According to one embodiment of the present invention, the movement is at least one of a relative up-and-down motion perpendicular to the panel, a relative circular motion on planes parallel to the panel.

According to one embodiment of the present invention, the driving component comprises a moving block, and the rotation component comprises a corresponding recession to be movably contact with the moving block. When one end of the moving block moves up and down in the recession, the rotation component with the cap is forced to rotate back and forth.

According to one embodiment of the present invention, the driving component may be a stroke switch assembly and the rotation component may be a shaft assembly.

According to one embodiment of the present invention, the button is a sliding button, which is provided with an inclined plane. The moving part of the driving component is accordingly provided with another inclined plane to be movably contact with the inclined plane of the sliding button. By moving the sliding button, the inclined plane of the sliding button touches the inclined plane of the moving part of the driving component, pushing the moving part to go upward or releasing the moving part to drop down.

According to one embodiment of the present invention, the button is a rotation button, and the driving component may be a gear assembly. The gear assembly and the shaft assembly both comprise a gear to be engaged with each other; the circular motion of the gear assembly causes the shaft assembly to rotate, and it further rotates caps mounted on the end of the shaft assembly.

According to one embodiment of the present invention, the shaft assembly is fixed via its outer wall into the inner wall of the connection structure and provided with two holes on one end face. The cap comprises two pins as its contact part, and covers the end face of the shaft assembly.

According to one embodiment of the present invention, the connection structure may be hollow and elongated, and the shaft assembly is provided at one end thereof. The rotating shaft of the shaft assembly extends from one end to the other end of the connection structure, at the same time the other cap is also provided at the other end of the central rotating shaft, therefore the rotation movement of the shaft assembly causes the central rotating shaft and further the two caps to rotate.

According to one embodiment of the present invention, the connection structure is hollow and elongated, and two shaft assemblies are provided at two ends thereof respectively without any common rotating shaft provided in between, each shaft assembly being provided with a cap.

According to one embodiment of the present invention, the connection structure is two separate hollow parts provided at the two ends of the panel respectively, each part containing a shaft assembly inside and each shaft being provided with a cap.

According to one embodiment of the present invention, the panel is an OLED panel.

According to one embodiment of the present invention, multiple LEDs are provided in the panel or in the connection structure.

According to one embodiment of the present invention, a diffuser, a guiding panel or a light shield is provided over the panel.

The other objective of the present invention is to provide an apparatus with the lighting device described above.

The advantages of the present invention are that anyone, such as an electrician, can easily install or replace the lighting device. Just by touching, pressing, sliding or rotating a button set on the surface of the panel, the rotation component is driven to rotate, and then the two pins of the two caps are quickly inserted into the corresponding sockets.

BRIEF DESCRIPTION OF THE DRAWINGS

These and other aspects of the present invention will now be described in more detail, with reference to the appended drawings showing example embodiments of the invention, wherein.

DETAILED DESCRIPTION OF EMBODIMENTS

In the following description, the present invention is described with reference to lighting device installed on the ceiling of a room, but it by no means limits the scope of the invention.

Figure 1:
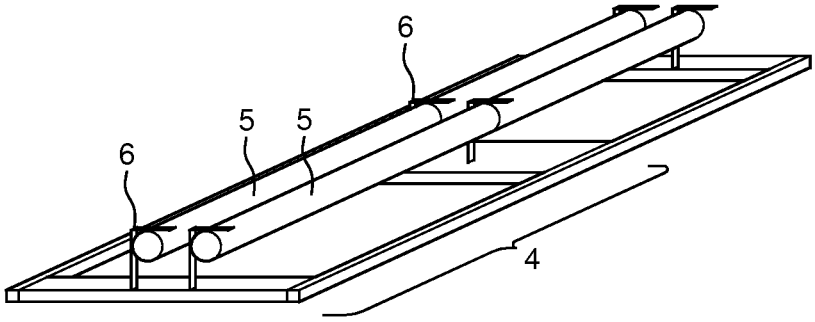
FIG. 1 illustrates a lighting device known from prior art.
Figure 2A:
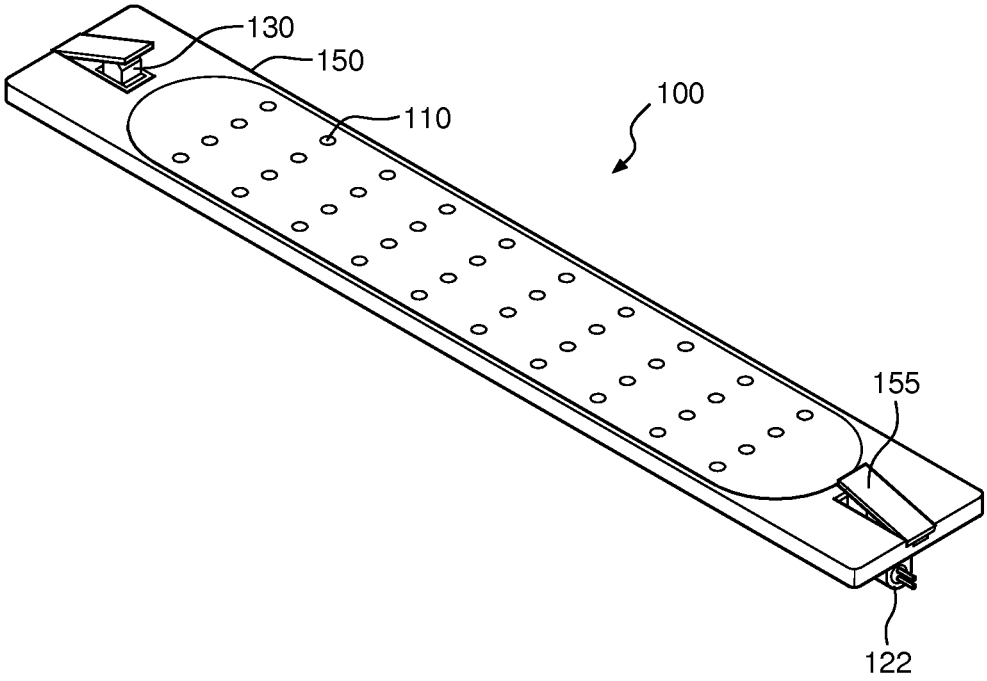
FIG. 2A and FIG. 2B are perspective views of a lighting device according to a first embodiment of the present invention, wherein 2A is the front view and 2B is the back view.
Figure 2B:
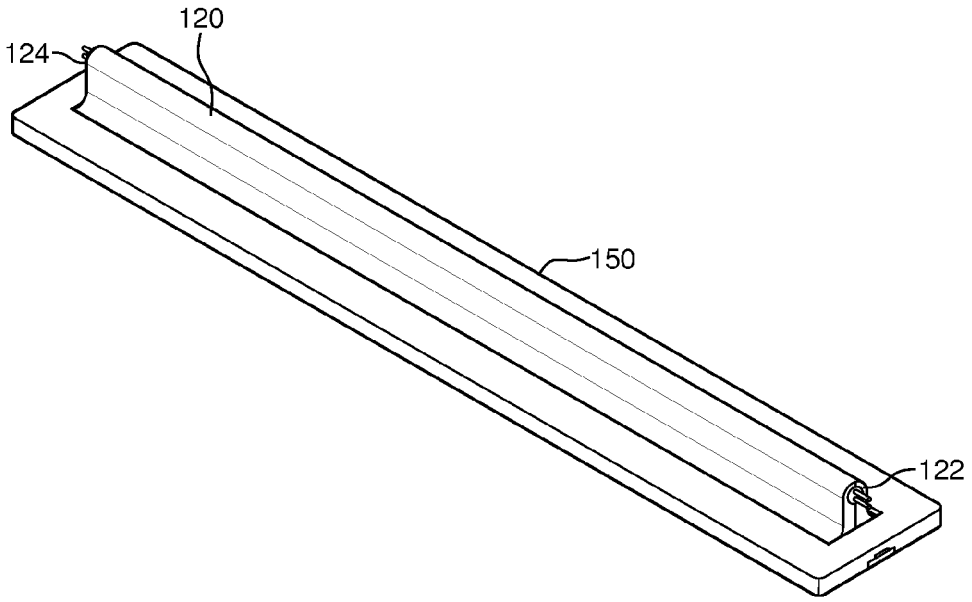

With reference to FIG. 2A and FIG. 2B, the lighting device 100 comprises many LEDs 110, a hollow and elongated connection structure 120 with two rotatable caps (122, 124) provided at two ends of the lighting device respectively, each cap (122, 124) being electrically connected with the LEDs and having a contact part, here are two pins (not marked with reference numbers), for being inserted into external sockets, and a transmission mechanism 130.

Figure 4:
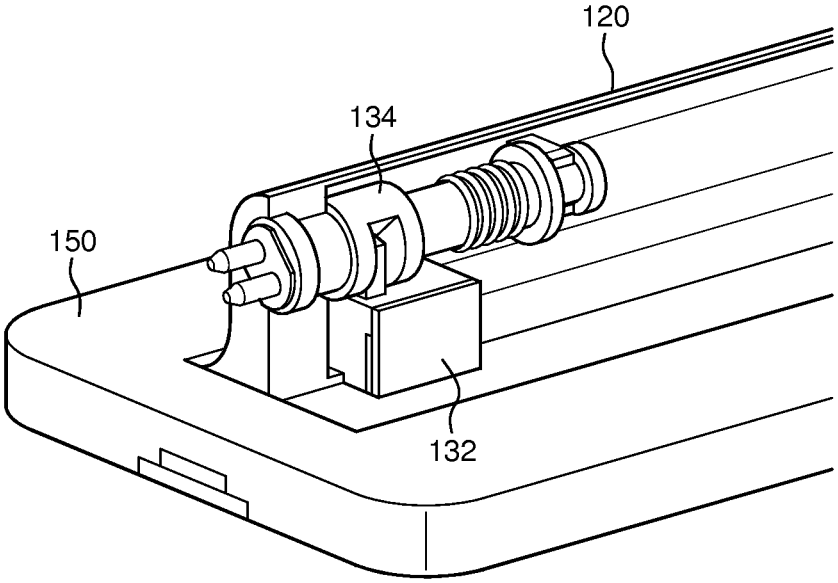
FIG. 4 is a perspective view of a transmission mechanism.

As FIG. 4 show, the transmission mechanism 130 comprises a driving component 132 provided through the panel 150 and a rotation component 134 provided inside the connection structure 120.

Figure 3:
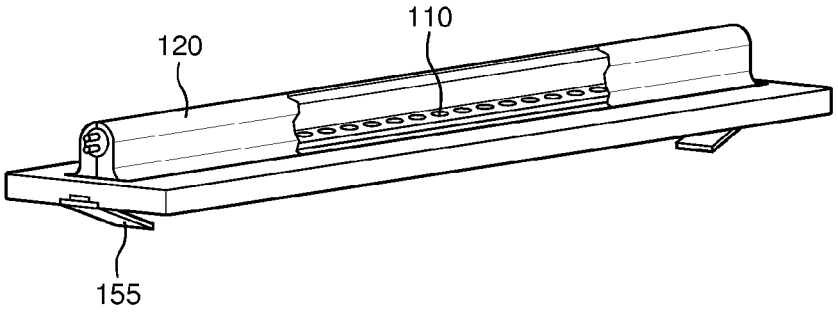
FIG. 3 is a perspective view of a lighting device according to another embodiment, wherein the LEDs are provided inside the connection tube, instead of in the panel.

In the present embodiment, LEDs 110 are provided inside a panel 150, which embodiment may be applied to the situation when sufficient light sources are available and therefore light uniformity can be met. The panel 150 is connected with its back to the connection structure 120. A button 155 (see FIG. 3 also) is provided on the front surface of the panel 150 and flexibly connected with the driving component 132. In another embodiment, which is shown in FIG. 3, the LEDs may also be provided inside the connection structure 120, because a certain distance of the LED sources from the panel can improve the light uniformity. It is worth mentioning that the connection structure can take other shapes other than the elongated shape, for example, a rectangular or an irregular shape. The LEDs can be placed in anywhere inside the connection structure, adjacent to or further from the panel 150.

The driving component 132 in the embodiment of FIG. 2, FIG. 3 and FIG. 4 is two stroke switches provided at two ends of the connection structure.

Figure 5A:
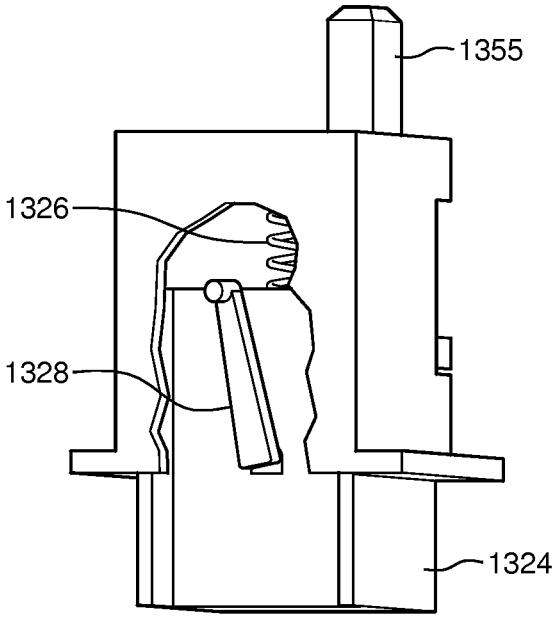
FIG. 5A and FIG. 5B are perspective view of a stroke switch.
Figure 5B:
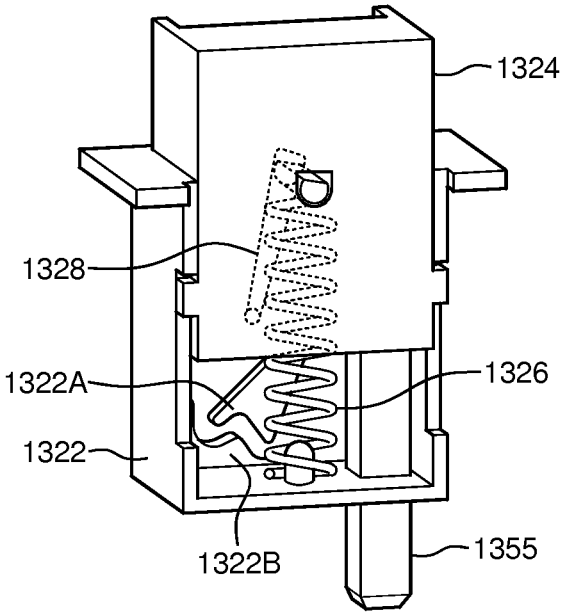
Figure 6:
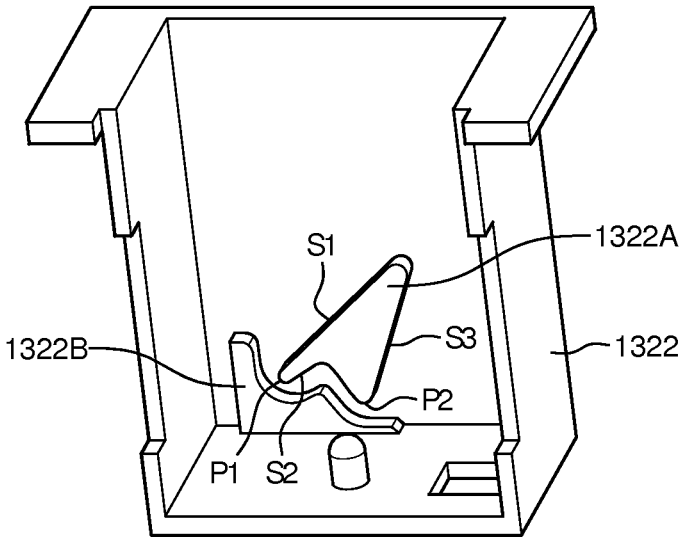
FIG. 6 is a perspective view of the shell of FIG. 5

The FIG. 5A and FIG. 5B show the perspective view of each stroke switch, one for a front view and the other for a back view. Each stroke switch comprises a stroke switch shell 1322, a slide block 1324, a spring 1326 and a crank 1328. The slide block 1324 is provided with a space inside for accommodating the spring 1326 and part of the crank 1328. The slide block 1324 can slide up and down along the sliding tracks provided at two inner sides of the shell 1322. In addition, the slide block is provided with a protruding part 1355 on the top, which is supposed to be contact with the rotation component. The crank 1328 is provided through the shell 1322 from the back to the front of the shell, and the spring 1326 is freely put on the crank 1328 inside the slide block. Since the space off the rotation component is limited, the spring is pressed when the slide block is forced to move towards the rotation component. As FIG. 6 shows, there are two raised areas 1322A and 1322B provided on the inner back wall of the shell 1322, which show specific shapes and are designed for limiting the movement trail and limiting the position of the crank 1328. For example, as FIG. 6 indicates, when a slide block is forced to move toward the rotation component along the sliding track of the shell and meets the raised area 1322A, the crank moves upward first along the slope side S1; when moving to the top point P1 of the slope side S1, the crank go down to the concave side S2 and stop there; if an upward force is again to exert to the slide block, the crank keeps moving and goes over another top point P2, and then go down along the other slope side S3, and finally return to its original position. During the whole process, the spring 1326 is pressed first; when the crank goes over another top point P2, the spring releases the elastic force and brings the crank back to the original position. The shapes of the raised areas may vary according to different requirements in terms of the stop position and moving distance of the slide block.

Figure 7:
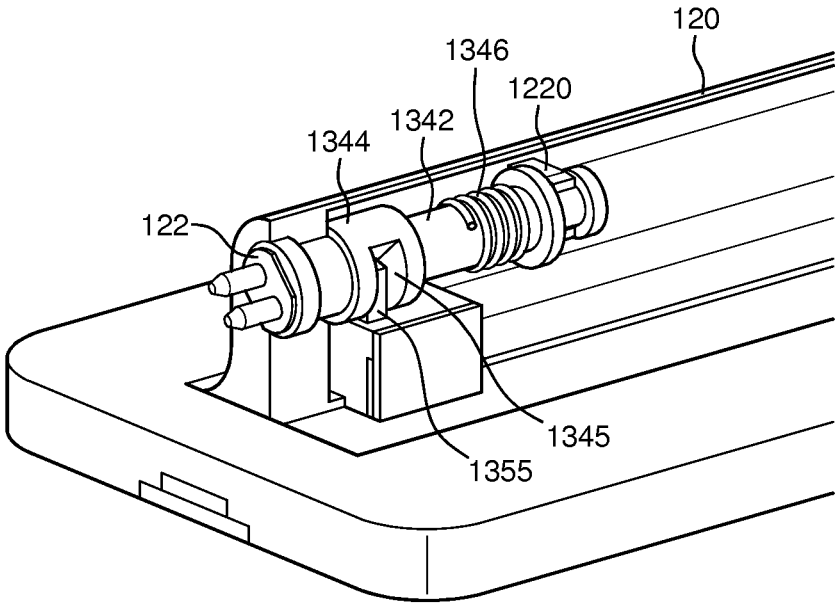
FIG. 7 is a perspective view of a shaft assembly.

According to the present embodiment, the rotation component could be two sets of shaft assemblies provided at two ends of the connection structure 120. With reference to FIG. 7 (only one set is shown), each shaft assembly comprises a rotating shaft 1342 and two ends. There are two supporters 1220 fixed on the inner wall of the connection structure 120, which are annular shape with an opening and wrap one rotating shaft 1342 in. Another cylindrical block 1344 with a larger radius is provided in between the two ends of each shaft assembly. A recession 1345 is provided in the cylindrical block 1344, which provides a loose room to allow the protruding part 1355 of the stroke switch to move up-and-down flexibly. A torsional spring 1346 is winded around the rotating shaft 1342. When forced to move upward and gets into the recession, the protruding part 1355 exerts a force to the cylindrical block 1344 and further drives the rotating shaft to rotate. When the protruding part 1355 moves down and leave the recession, the torsional spring automatically brings the rotating shaft back to the original still status.

There are two pinholes provided on one end surface of each shaft assembly for accommodating two pins of the caps. The caps are set to cover the ends of the shaft assembly that have pinholes. The pins extend from the pinholes and go through the caps (122, 124).

The two sets of transmission mechanisms (two driving components and two rotation components) described in the present embodiment can ensure a strong and stable rotation force for the rotating shaft.

It should be understood that the stroke switch and the shaft assembly can be modified by adding, removing or changing structures or parts to fulfill other purposes or improve the performance, and all of these modification should be fallen into the protection of the present invention.

Figure 8:
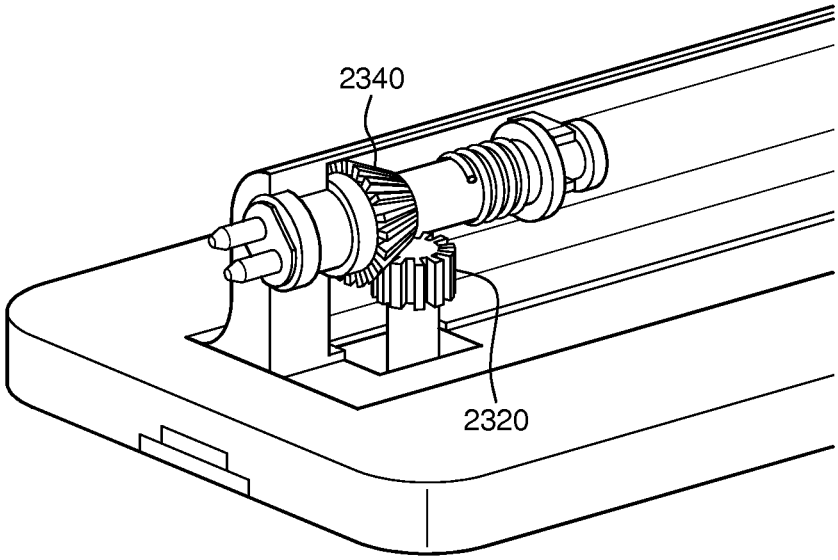
FIG. 8 is a perspective view of another embodiment of the transmission mechanism.
Figure 9:
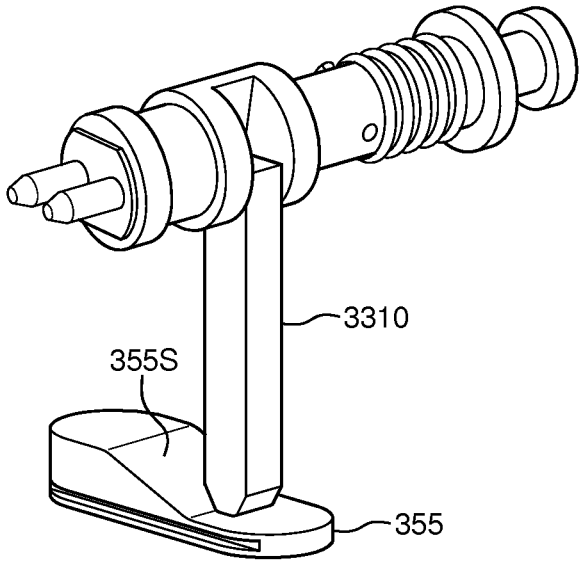
FIG. 9 shows an embodiment for the button.

When doing an up-and-down motion, the driving component usually comprises a moving part, same or similar as the one in FIG. 4. As an alternative, FIG. 9 shows a sliding button and a corresponding moving part of a driving component. A sliding button 355 is provided on the panel of the lighting device, which has an inclined plane 355S. The driving component may comprise a shaft 3310 to be flexibly mechanically in contact with the sliding button 355 via an end with a corresponding inclined plane. When the sliding button 355 is slid back and forth on the surface of the panel, the shaft 3310 is pushed up and down along the slope surface 355S and this therefore makes the main rotating shaft of the rotation component rotate and counter-rotate. As another embodiment shown in FIG. 8, a driving component could be a gear assembly and a rotation component is a shaft assembly. The gear assembly comprises a gear 2320 in one end, which is engaged with the gear 2340 provided around the main rotating shaft of the shaft assembly. To operate theses gears, a rotation button is provided on the surface of the panel (the button is hidden by the panel and so not shown). The rotation button is provided in the other end of the gear assembly and the gear may share a same rotating axis. By turning the rotation button back and forth, two engaged gears bring the main rotating shaft to rotate, and therefore the relative circular motion of the gear assembly on a plane parallel to the panel makes the caps mounted on the end of the shaft assembly rotate back and forth.

In the foregoing embodiments, each shaft assembly has an independent rotating shaft, which means that a same hollow elongated connection structure contains two independent shaft assemblies in these embodiments. However, as a simplest alternative for a lighting device with a hollow and elongated connection structure, it is also fine to have only one set of transmission mechanism 130 (one driving component plus one rotation component) in order to enable caps to rotate. In this scenario, the rotating shaft of the only one rotation component extends from one end to the other end of the connection structure. When two caps are provided at two ends of the only one rotating shaft, the rotation of the only one rotation component can cause the both caps to rotate as well. The only one set of transmission mechanism may be provided either closer to any one cap, or in the middle position.

Figure 10:
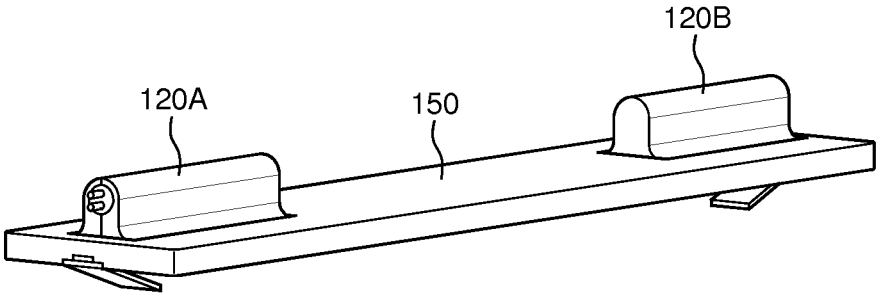
FIG. 10 is a perspective view of another embodiment, which is provided with an OLED film and has two separate connection structures.

As another embodiment shows, the panel 150 is coated with an OLED film, as shown in FIG. 10. In this embodiment, the connection structure may adopt two separate connection structures (120A, 120B) provided respectively at two ends of the back of the panel 150. Inside each separate structure (120A, 120B), there is a rotation component. One end of each separate structure is covered by a cap. The separate structures especially fit the OLED film because no light sources need to be installed in a connection structure with more space; however, it can be used in other embodiments as well.

To fulfill different light effects and as another embodiment, the lighting device may further comprise a light guide panel, a diffuser or a light shield provided over the panel. Especially, when a light guide panel or diffuser is chose, the LEDs may be provided on the sides of the light guide panel.

Figure 11:
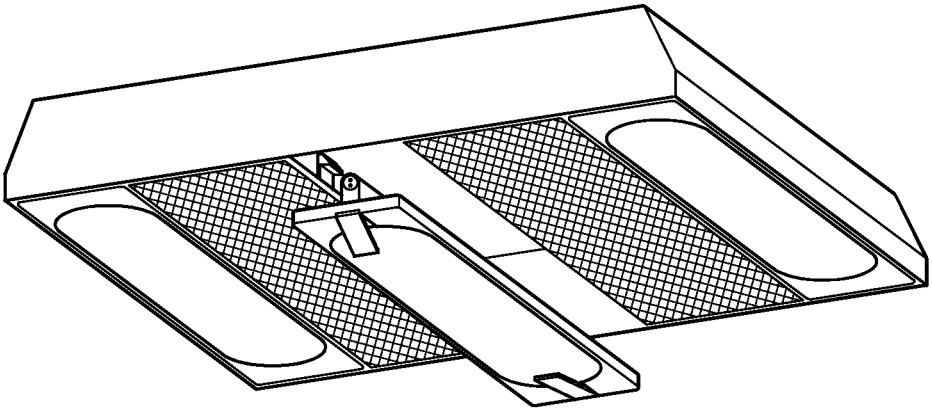
FIG. 11 is a schematic view of a luminaire with the lighting device described in other figures.

FIG. 11 is schematic view to show a luminaire with the light device. In practice, an addition optical unit and other mechanical units can be assembled to the lighting device. As an alternative, the driver can be provided separately away from the lighting device.

Additionally, variations to the disclosed embodiments can be understood and effected by the skilled person in practicing the claimed invention, from a study of the drawings, the disclosure, and the appended claims. For example, the shape of the connection structure 120 may be different from what is disclosed in the illustrated examples. The driving component and rotation component may choose other types of assembly. The lighting device may be installed in any possible place, such as on the wall or on the ceiling. The light source may be a fluorescent.

In the claims, the word "comprises" does not exclude other elements, and the indefinite article "a" or "an" does not exclude a plurality.

The invention claimed is:

1. A lighting device, comprising a light source;

a connection structure comprising a cap provided at an end thereof; and a transmission mechanism, the cap is electrically connected with the light source and has a contact part for being inserted into an external socket, the transmission mechanism comprises a driving component movably connected to a rotation component on which the cap is mounted, wherein a movement of the driving component relative to the rotation component causes the rotation component with the cap to rotate; wherein the lighting device further comprises a panel mechanically connected with the connection structure and movably connected with the driving component via a button provided on the panel.

2. The lighting device recited in claim 1, wherein the movement is at least one of a relative up-and-down motion perpendicular to the panel, and a relative circular motion on planes parallel to the panel.

3. The lighting device recited in claim 2, wherein the driving component comprise a moving block, and the rotation component comprises a corresponding recession, the driving component and the rotation component being configured in such a way that when one end of the moving block moves up and down in the recession, the rotation component with the cap is forced to rotate back and forth.

4. The lighting device recited in claim 3, wherein the driving component is a stroke switch assembly and the rotation component is a shaft assembly.

5. The lighting device recited in claim 3, wherein the button is a sliding button with an inclined plane, and the moving block is provided with a corresponding inclined plane to be movably in contact with the inclined plane of the sliding button.

6. The lighting device recited in claim 1, wherein the button is a rotation button, the driving component is a gear assembly and the rotation component is a shaft assembly, the gear assembly and the shaft assembly both comprising a gear to be engaged with each other, a relative circular motion of the gear assembly causing the shaft assembly to rotate.

7. The lighting device recited in claim 4, wherein the connection structure is hollow; the shaft assembly is fixed via its outer wall into the inner wall of the connection structure; the shaft assembly is provided with two holes at its one end face; the cap comprises two pins as its contact part; the cap is mounted on the one end face of the shaft assembly.

8. The lighting device recited in claim 7, wherein the connection structure is elongated; the shaft assembly is provided at one end of the connection structure and has a rotating shaft extending from the one end to the other end of the connection structure, the other end of the rotating shaft being provided with another cap.

9. The lighting device recited in claim 7, wherein the connection structure is elongated; two shaft assemblies are provided at two ends of the connection structure respectively, each shaft assembly being provided with a cap.

10. The lighting device recited in claim 7, wherein the connection structure is two separate parts provided at two ends of the panel respectively, each part containing a shaft assembly inside and each shaft assembly being provided with a cap.

11. The lighting device recited in claim 1, wherein the panel is provided with an OLED film on the surface.

12. The lighting device recited in claim 1, wherein multiple LEDs are arranged in the panel or in the connection structure.

13. The lighting device recited in claim 1, wherein a light guiding panel, a light shield or a diffuser is provided over the panel.

14. A luminaire, comprising at least one lighting device recited in claim 1.

* * * * *